US008109517B2

(12) United States Patent
Miller

(10) Patent No.: US 8,109,517 B2
(45) Date of Patent: Feb. 7, 2012

(54) HAND HELD PRODUCT FOR PLAYING A GAME

(76) Inventor: Daunielle L. Miller, Auburn, AL (US)

( * ) Notice: Subject to any disclaimer, the term of this patent is extended or adjusted under 35 U.S.C. 154(b) by 0 days.

(21) Appl. No.: 12/652,107

(22) Filed: Jan. 5, 2010

(65) Prior Publication Data

US 2011/0163502 A1 Jul. 7, 2011

(51) Int. Cl.
*A63B 67/00* (2006.01)

(52) U.S. Cl. ..... 273/317.3; 273/412

(58) Field of Classification Search ..... 273/317, 273/317.1, 317.3, 331, 412; D21/305, 466, D21/701

See application file for complete search history.

(56) References Cited

U.S. PATENT DOCUMENTS

| | | | | | |
|---|---|---|---|---|---|
| 2,570,860 | A | * | 10/1951 | Redding | 273/329 |
| D174,327 | S | * | 3/1955 | Jonesi | D21/466 |
| 3,092,387 | A | * | 6/1963 | Wagner | 273/317.3 |
| 3,244,420 | A | * | 4/1966 | Poynter | 273/402 |
| D235,897 | S | * | 7/1975 | Breneman | D21/702 |
| 3,907,297 | A | * | 9/1975 | Di Leva | 473/507 |
| 4,000,898 | A | * | 1/1977 | Cooter | 473/512 |
| 4,175,746 | A | * | 11/1979 | McRitchie | 273/317.3 |
| D307,040 | S | * | 4/1990 | Helalian | D21/466 |
| D326,483 | S | * | 5/1992 | Willis | D21/466 |
| 5,192,080 | A | * | 3/1993 | Duncan | 273/412 |
| D337,199 | S | * | 7/1993 | Ochs | D12/420 |
| 5,348,307 | A | * | 9/1994 | Duggan | 473/507 |
| 5,368,306 | A | * | 11/1994 | Madsen | 473/510 |
| 5,713,575 | A | * | 2/1998 | Angelucci | 273/317.3 |
| 5,829,751 | A | * | 11/1998 | Willis | 273/330 |
| D407,894 | S | * | 4/1999 | Myles | D2/976 |
| 6,220,917 | B1 | * | 4/2001 | Nelson | 446/27 |
| 7,374,503 | B2 | * | 5/2008 | Mullins | 473/479 |
| 7,611,146 | B2 | * | 11/2009 | Arden | 273/317 |
| 7,641,199 | B1 | * | 1/2010 | Clarke | 273/330 |
| 2003/0034611 | A1 | * | 2/2003 | Lacy | 273/317.3 |
| 2006/0290062 | A1 | * | 12/2006 | Sorrells | 273/317.3 |

* cited by examiner

*Primary Examiner* — Raleigh W. Chiu
(74) *Attorney, Agent, or Firm* — Jones IP Law, LLC; Dennis W. Jones

(57) ABSTRACT

A hand-held product for playing a game is disclosed. The hand-held game includes a basketball goal assembly and a ring coupled to the basketball goal assembly that can be attached to the finger, wrist, arm, or other body parts or limbs of a user. The basketball goal assembly includes a backboard and a rim. The rim can be foldable. In one embodiment, the ring is adjustable to fit different sized fingers, wrists, arms, or other body parts. The adjustable ring can be an adjustable band with adjusters at ends of the band. The ring is coupled to the basketball goal assembly using at least one of an adhesive, tape, a snap-on clip, a press fit mechanism, a mounting bracket, welding and molding. The hand-held game can come in a variety of sizes, shapes, and colors.

15 Claims, 7 Drawing Sheets

HAND HELD PRODUCT FOR PLAYING A GAME

FIELD OF THE INVENTION

This invention relates to a hand-held game. More specifically, this invention relates to hand-held product for playing a game that includes a ring coupled to a basketball goal assembly that can be attached to the finger, wrist, hand, arm, or any other body part of a user.

BACKGROUND OF THE INVENTION

There are many toys related to basketball and to basketball games which may be used by both adults and children. These toys, which include miniaturized basketball-type apparatuses that fit on waste paper baskets, hook over the upper edge of a door, or mount to a generally vertical surface, are typically found in a residence or work place. These basketball toys are smaller than regulation basketball apparatuses and consequently utilize a smaller ball. Numerous other innovations for basketball toys have been provided in the art that are adequate for various purposes.

While these items fulfill their respective, particular objective and requirements, the aforementioned basketball toys have obvious constraints and suffer from common disadvantages making them undesirable for use in certain settings. For example, these basketball toys require attachment to other structures (e.g., a door, a wall, or a wastepaper basket) and require some assembly prior to use. Thus, they cannot be played at any place or location—such as the back seat of an automobile, on an airplane, or at a public park. Because of their size and bulkiness, these toys also do not make useful novelty games and devices as stocking stuffers, as give-away items at a sporting event or in connection with sales of a particular product or product promotions in general. Furthermore, many of these items are not amusing or otherwise appealing to the user.

What is needed is a hand-held product for playing a basketball game that is very inexpensive to manufacture, easily portable, practical as a novelty item, and appealing to users.

SUMMARY OF THE INVENTION

The present invention is directed to a hand-held game. In accordance with one embodiment of the present invention, the hand-held game comprises a basketball goal assembly including a backboard and a rim; and a ring coupled to the basketball goal assembly. The hand-held game also includes a net coupled to the rim. The net can be made of nylon or plastic. In one embodiment, the ring is adjustable to fit different sized fingers, wrists, arms, or other body parts. For example, the ring can comprise an adjustable band including adjusters at ends of the band to fit different sized fingers, wrists, arms, or other body parts or limbs.

The ring can be coupled to the basketball goal assembly using at least one of the following: an adhesive, tape, a snap-on clip, a press fit mechanism, a mounting bracket, welding, and molding. The rim can be coupled to the backboard via a mount. In one embodiment, the rim is foldable. The backboard and the rim can be made of plastic or metal. In one embodiment, the adjustable band comprises a Velcro strap including adjusters at ends of the Velcro strap.

In accordance with another embodiment of the present invention, a hand-held game is disclosed. The hand-held game comprises a basketball goal assembly including a backboard and a rim; and a band coupled to the backboard or the rim of the basketball goal assembly. In one embodiment, the band is adjustable and can also be a ring or band that fits various sizes of fingers, wrists, arms, or other body parts.

In accordance with another embodiment of the present invention, a method of making a hand-held game is disclosed. The method comprises providing a basketball goal assembly, the basketball goal assembly including a backboard and a rim; and coupling a band to one of the backboard and the rim of the basketball goal assembly. The band can be an adjustable band that includes adjusters at ends of the band to fit different sized fingers, wrists, arms, or other body parts. In one embodiment, the band is a ring.

DETAILED DESCRIPTION OF THE PREFERRED EMBODIMENTS

Figure 1:
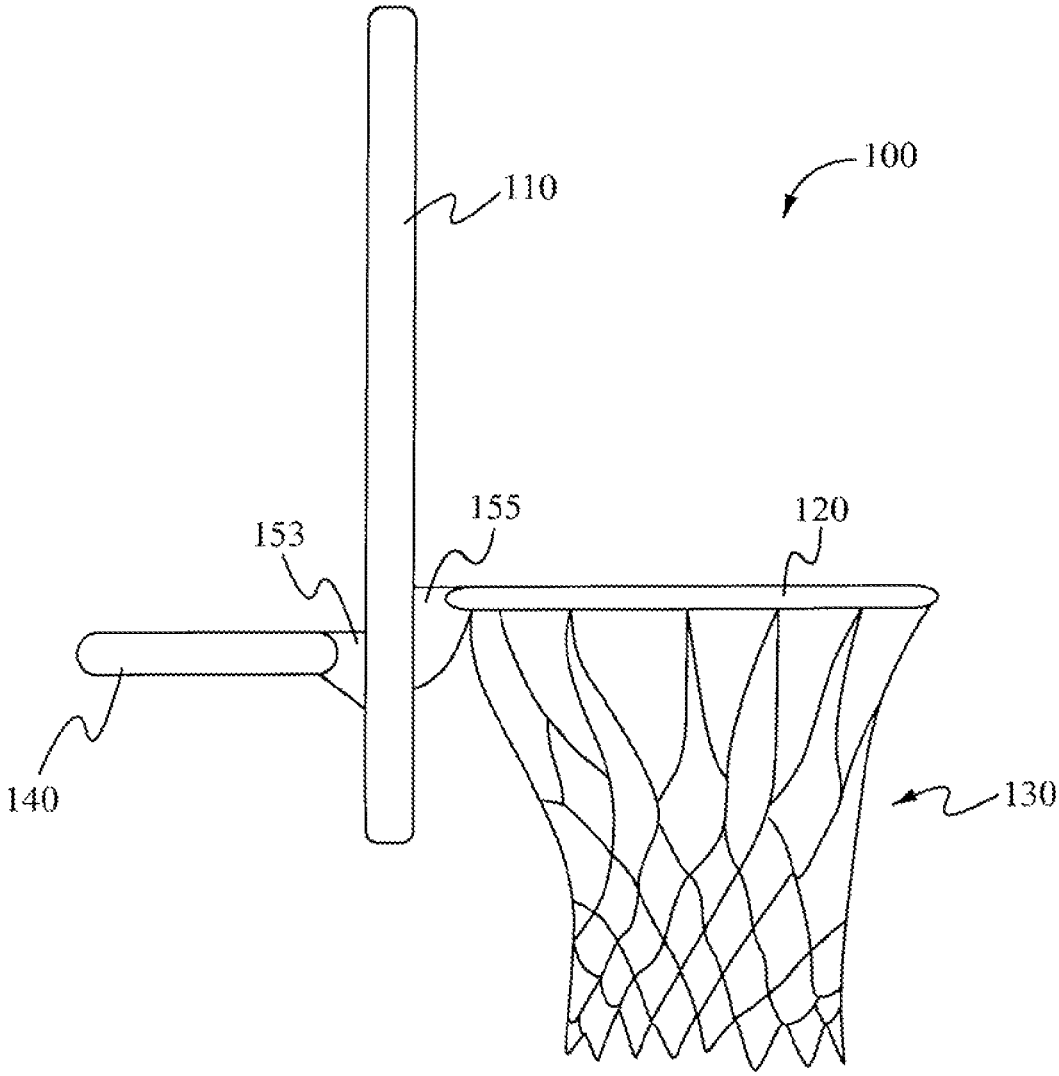
FIG. 1 shows a side view of a basketball goal assembly coupled to a ring, in accordance with one embodiment of the present invention.

FIG. 1 shows a side view of a basketball goal assembly 100 coupled to a ring 140, in accordance with one embodiment of the present invention. The basketball goal assembly 100 includes a backboard 110 and a rim 120. In one embodiment, the basketball goal assembly 100 further includes a bracket 155 that mounts the rim 120 to the backboard 110. The rim 120 can include a net 130 and be made of, but not limited to, nylon or plastic. The ring 140 is coupled to the basketball goal assembly 100 using any of the following: an adhesive, adhesive tape, a snap-on clip, a press-fit mechanism, welding, or molding. In one embodiment, the ring 140 is coupled to the basketball goal assembly 100 via a mount 153. However, as noted, the mount 153 can be replaced with any device or mechanism that can couple the ring 140 to the basketball goal assembly 100.

In one embodiment of the present invention, the ring 140 is adjustable to fit different sized fingers, wrists, arms or other body parts or expandable to fit a variety of finger, wrist, arm, or other body part sizes. The ring 140 can comprise an adjustable band that can be tightened, loosened or otherwise adjusted to fit different sized fingers, wrists, arms or other body parts. In one embodiment, the adjustable band comprises a Velcro strap that includes adjusters at ends of the Velcro strap. The ring 140 can be made of metal, plastic, wood, glass, gemstone or other materials and can come in a variety of sizes, colors, and shapes, including circular or semi-circular shape designs.

The backboard 110 and the rim 120 can be made of any number of materials, including plastic or metal. In one embodiment, the rim 120 is foldable and can fold up or fold down. Any small or miniature ball that can be shot into the rim 120 can be used with the hand-held game of the present invention. The ball can be, but not limited to, a miniature basketball squeeze ball, "crush" ball, foam basketball, or stress ball.

Figure 2:
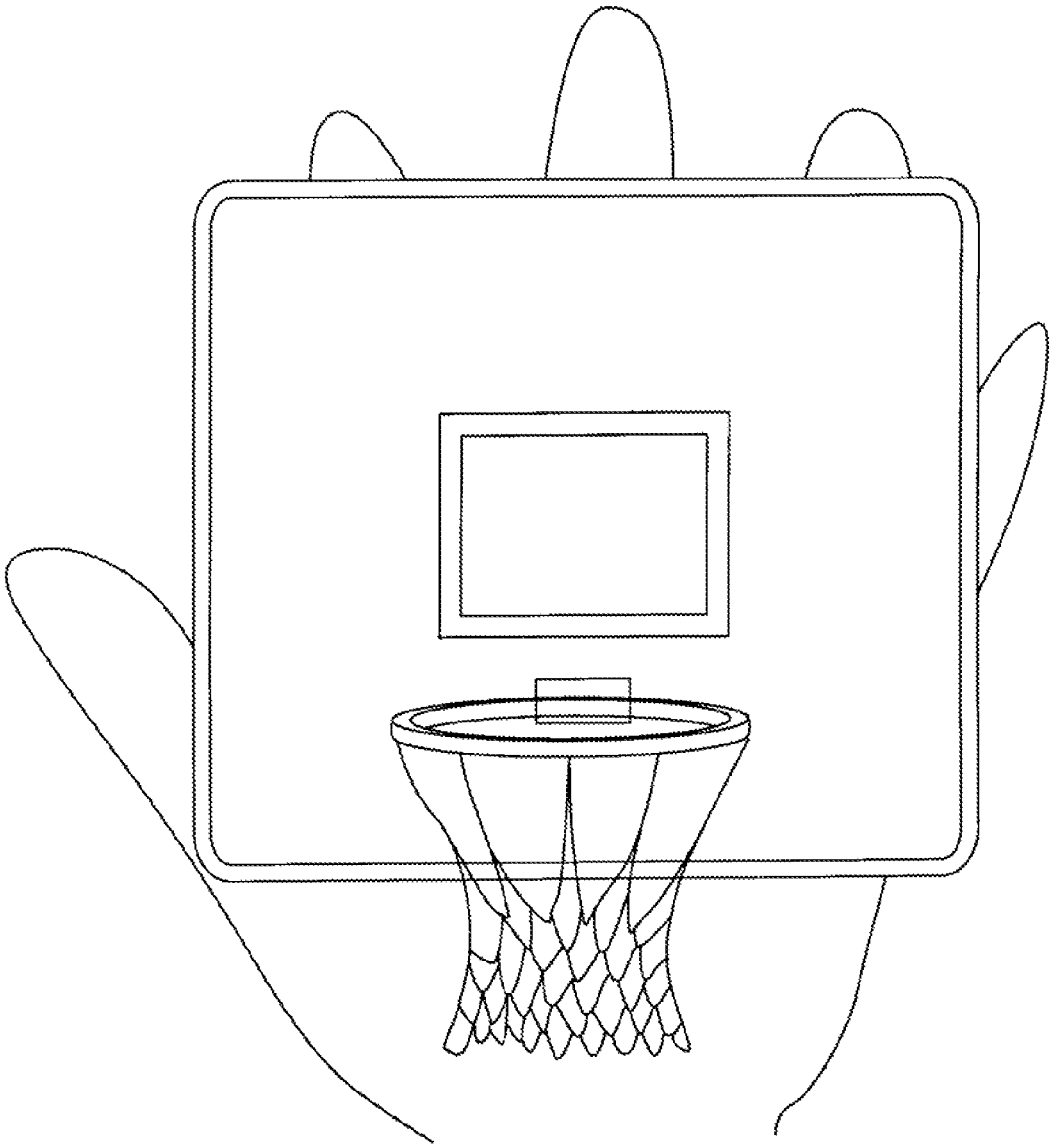
FIG. 2 shows a front view of a basketball goal assembly of a hand-held game, in accordance with one embodiment of the present invention.

FIG. 2 shows a front view of a basketball goal assembly of a hand-held game, in accordance with one embodiment of the present invention. The basketball goal assembly includes a backboard and a rim. A ring or band (not shown in the front view of FIG. 2) that fits on a finger, wrist. arm, or other body part of a user is coupled to the basketball goal assembly. In one embodiment, the ring or band is coupled to either the backboard or the rim of the basketball goal assembly. The rim can include a net.

Figure 3:
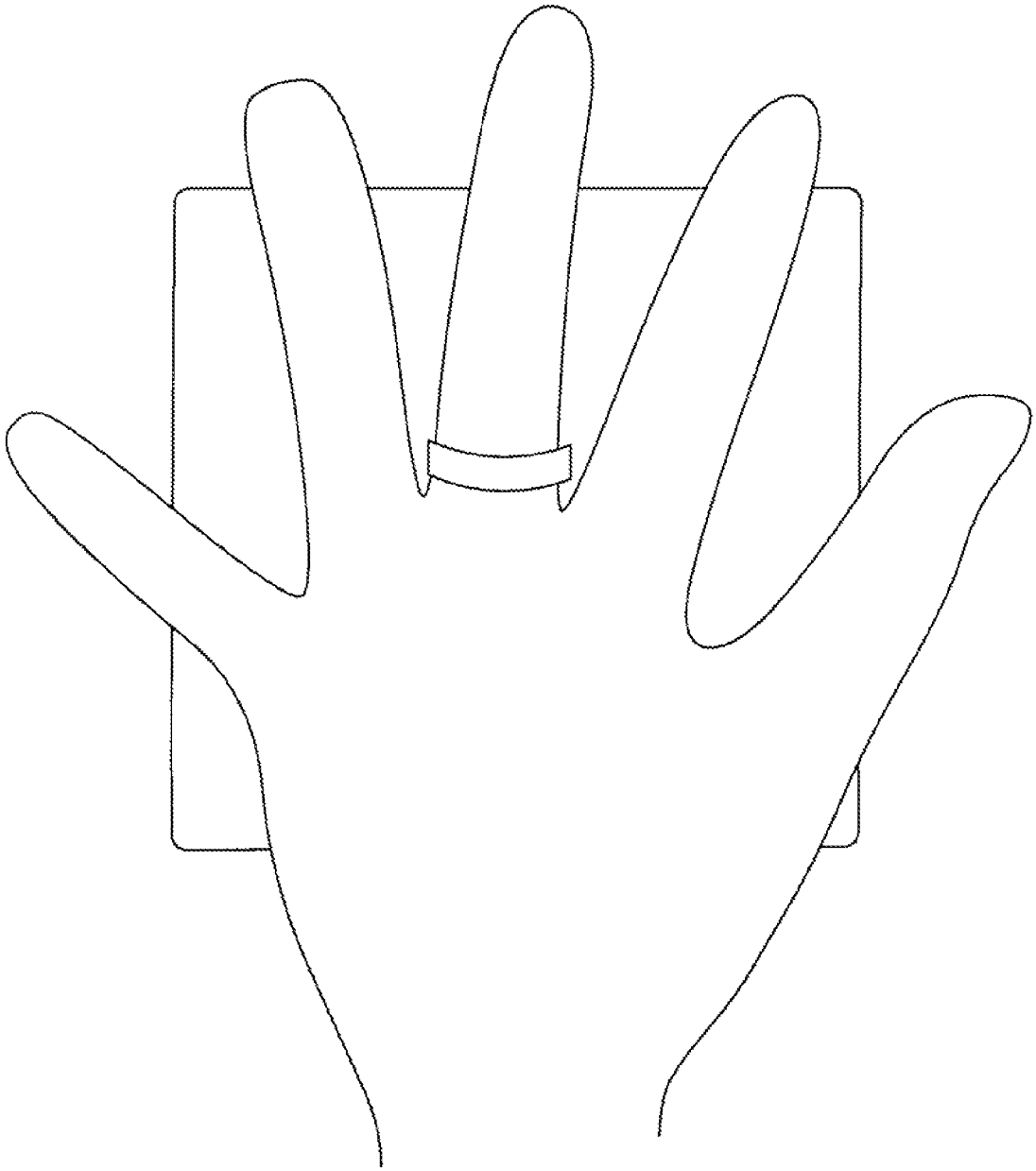
FIG. 3 shows a back view of a hand-held game including a ring coupled to a basketball goal assembly, in accordance with one embodiment of the present invention.

FIG. 3 shows a back view of a hand-held game including a ring coupled to a basketball goal assembly, in accordance with one embodiment of the present invention. The basketball goal assembly includes a backboard and a rim (not shown in the back view of FIG. 3). As shown in the FIG. 3, a ring or band is worn on a finger, wrist, arm or other body part of a user and is coupled to the basketball goal assembly. In one embodiment, the ring or band is coupled to either the backboard or the rim of the basketball goal assembly.

Figure 4:
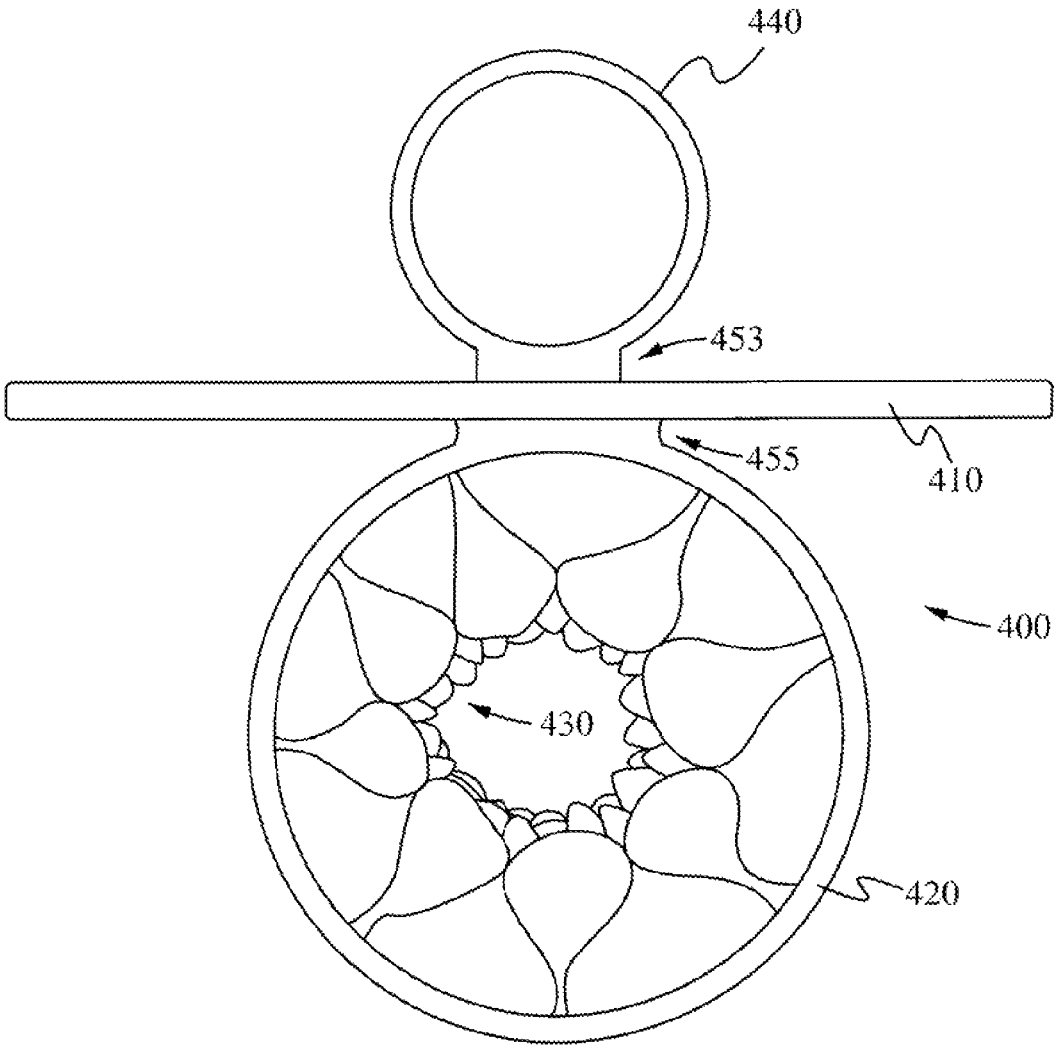
FIG. 4 shows a top view of a basketball goal assembly coupled to a ring, in accordance with one embodiment of the present invention.

FIG. 4 shows a top view of a basketball goal assembly 400 coupled to a ring 400, in accordance with one embodiment of the present invention. The basketball goal assembly 400 includes a backboard 410 and a rim 420. In one embodiment, the basketball goal assembly 400 further includes a bracket 455 that mounts the rim 420 to the backboard 410. The rim 420 can include a net 430 and be made of, but not limited to, nylon or plastic. The ring 440 is coupled to the basketball goal assembly 400 using any of the following: an adhesive, adhesive tape, a snap-on clip, a press-fit mechanism, welding, or molding. In one embodiment, the ring 440 is coupled to the basketball goal assembly 100 via a mount 453. However, as noted, the mount 453 can be replaced with any device or mechanism that can couple the ring 140 to the basketball goal assembly 100. The ring 440 can be an adjustable band that adjusts or expands to fit different sized rings or ring sizes as well as wrists, arms, or other body parts.

Figure 5:
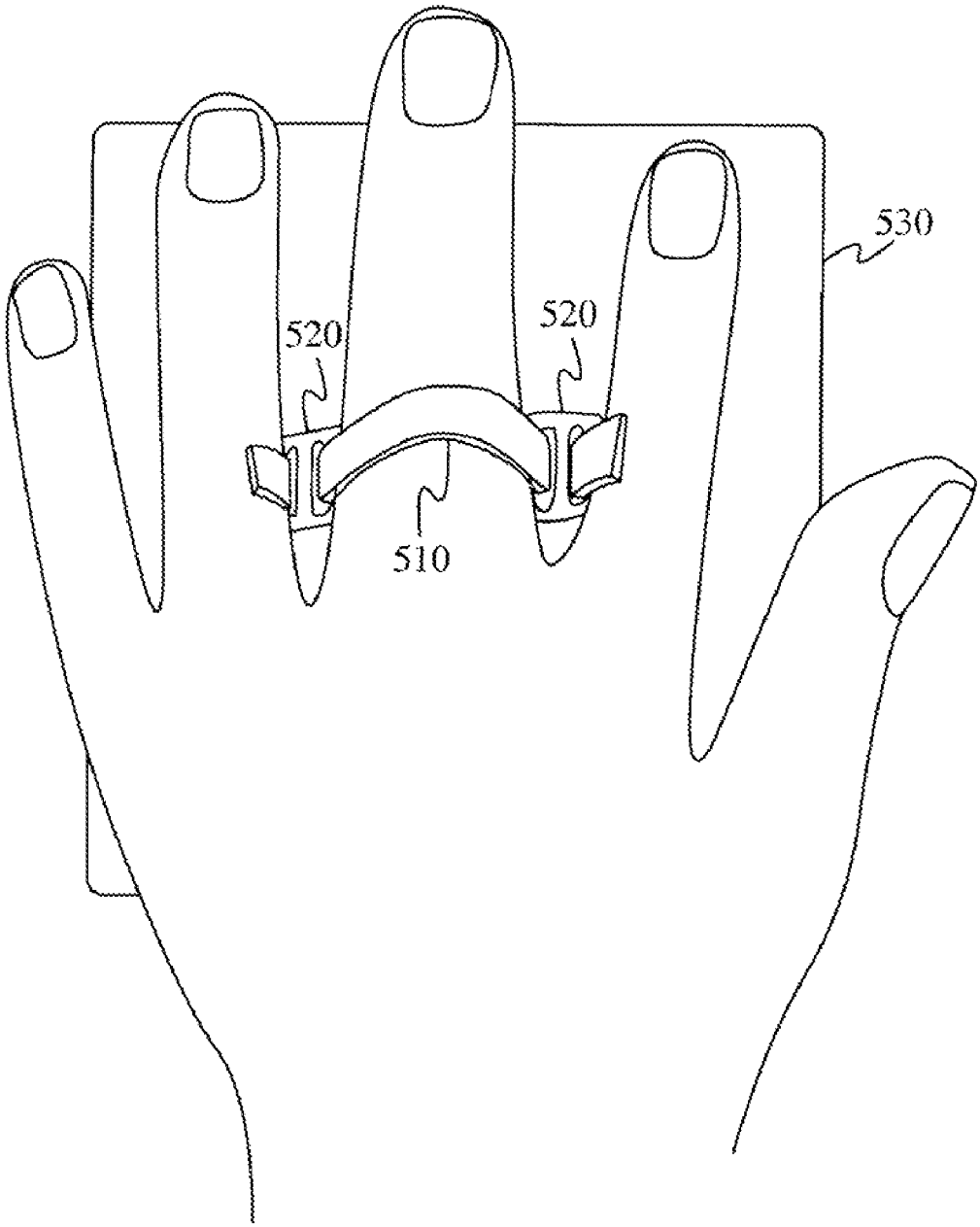
FIG. 5 shows a back view of a hand-held game including an adjustable band coupled to a basketball goal assembly, in accordance with one embodiment of the present invention.

FIG. 5 shows a back view of a hand-held game including an adjustable band 510 coupled to a basketball goal assembly, in accordance with one embodiment of the present invention. The adjustable band 510 includes adjusters 520 at ends of the adjustable band 510 to either tighten or loosen the band 510 to fit different sized fingers, wrists, arms, or other body parts. The adjustable band 510 is coupled to the basketball goal assembly. In one embodiment, the band 510 is coupled to either a backboard 530 or a rim (not shown in the back view of FIG. 5) of the basketball goal assembly.

Figure 6:
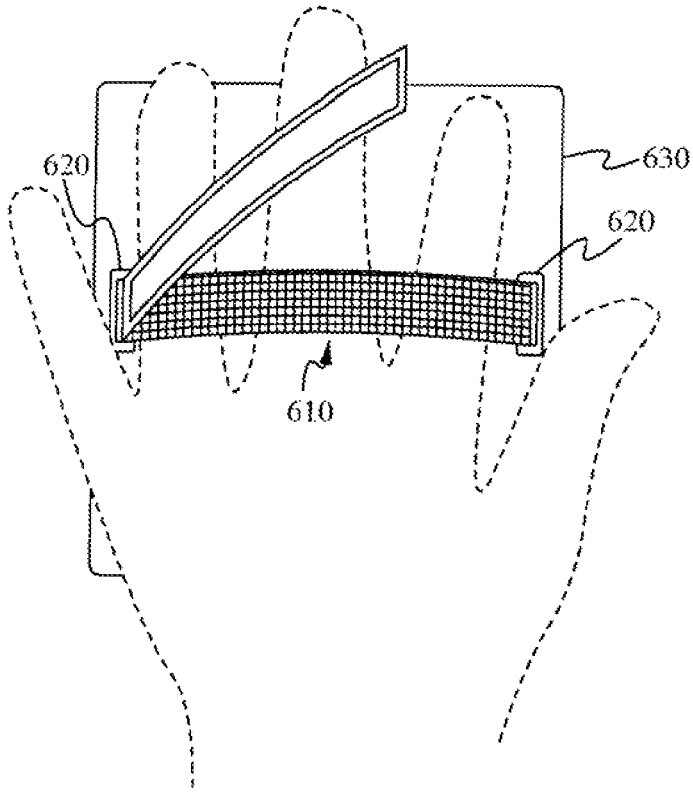
FIG. 6 shows a back view of a hand-held game including a Velcro strap coupled to a basketball goal assembly, in accordance with one embodiment of the present invention.

FIG. 6 shows a back view of a hand-held game including a Velcro strap 610 coupled to a basketball goal assembly, in accordance with one embodiment of the present invention. The Velcro strap 610 includes adjusters 620 at ends of the Velcro strap 610 to either tighten or loosen the strap 610 to fit different sized fingers or hands, wrists, arms, or other body parts. In the FIG. 6, the Velcro strap 610 is fitted around three fingers of the hand of a user, but can be fitted around more or less fingers of the hand. The Velcro strap 610 is coupled to the basketball goal assembly. In one embodiment, the Velcro strap 610 is coupled to either a backboard 630 or a rim (not shown in the back view of FIG. 6) of the basketball goal assembly.

Figure 7:
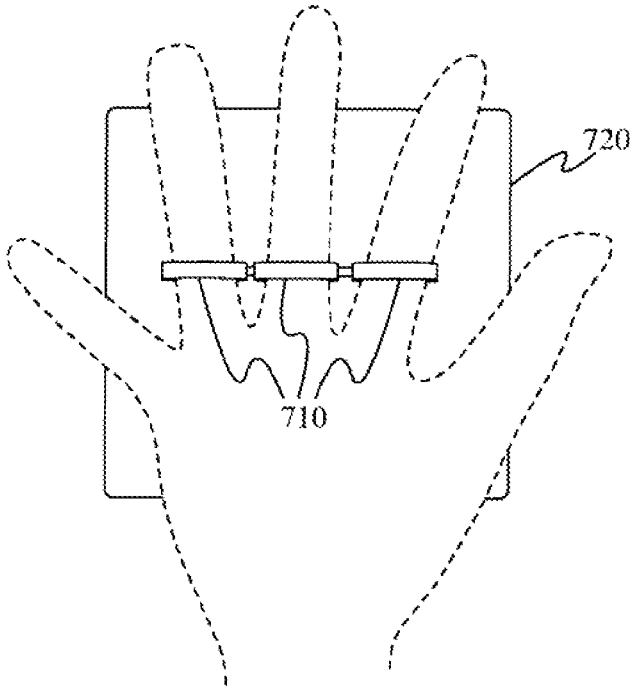
FIG. 7 shows a back view of a hand-held game including multiple rings coupled to a basketball goal assembly, in accordance with one embodiment of the present invention.

FIG. 7 shows a back view of a hand-held game including multiple rings 710 coupled to a basketball goal assembly, in accordance with one embodiment of the present invention. The multiple rings 710 can be adjustable or expandable to fit different sized fingers, wrists, arms, or other body parts. In one embodiment, the multiple rings are multiple adjustable bands. In the FIG. 7, the multiple rings 710 comprise three rings on the hand of a user. However, it will be appreciated that more or less rings can be coupled together and fit on fingers, wrists, arms, or other body parts of the user. The multiple rings 710 are coupled to the basketball goal assembly. In one embodiment, the multiple rings are coupled to either a backboard 720 or a rim (not shown in the back view of FIG. 7) of the basketball goal assembly.

Figure 8:
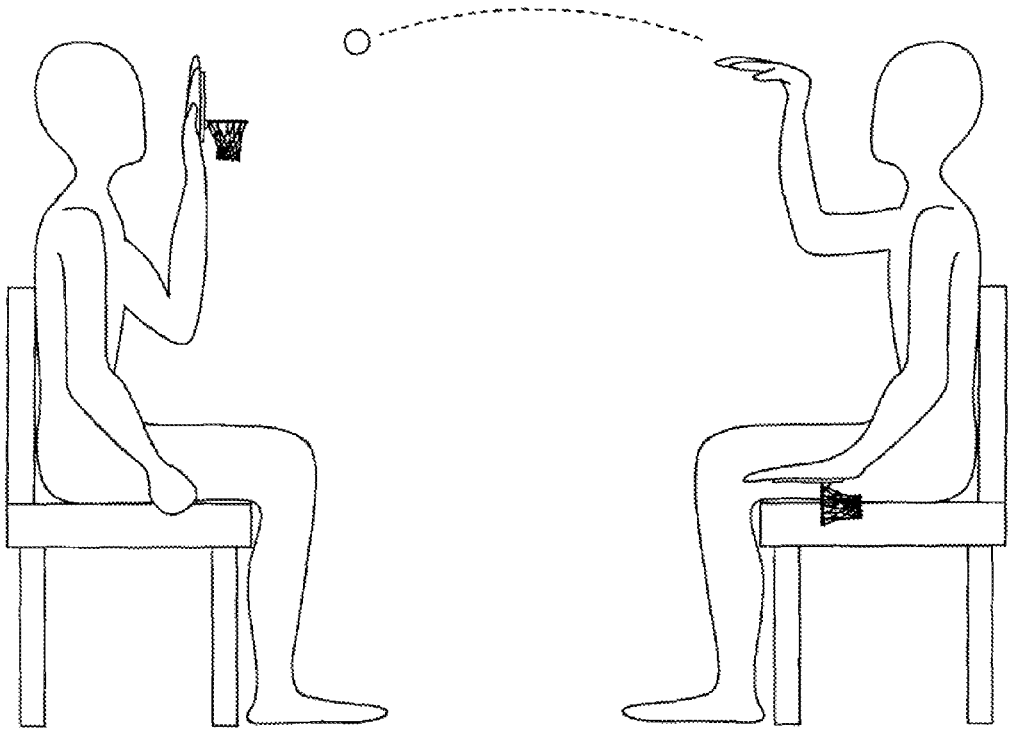
FIG. 8 shows an embodiment of a hand-held game of the present invention being played by two users.

FIG. 8 shows an embodiment of a hand-held game of the present invention being played by two users. In this embodiment, a first user is shooting a miniature ball at a basketball goal assembly—of the hand-held game of the present invention—which is being held by a second user. The first user is also holding a hand-held game of the present invention of her own in her non-shooting hand. After the first user has shot the ball, the second user can take his turn at shooting the ball at the hand-held game of the first user. It will be appreciated that the hand-held game can be played with more users or players or, alternatively, can be played alone with a single player holding the hand-held game in one hand and shooting the ball with the other hand.

As noted above, the present invention is concerned with, but is not limited to, novelty games and devices which are useful as stocking stuffers, as give-away items at sporting events or in connection with sales of a particular product or product promotions in general showing a team or company logo. The hand-held game of the present invention is inexpensive to manufacture, easily portable, requires little space and can be played at home or around the office, on long road trips, at a party, bar or other social settings.

The present invention has been described in terms of specific embodiments incorporating details to facilitate the understanding of principles of construction and operation of the invention. Such reference herein to specific embodiments and details thereof is not intended to limit the scope of the claims appended hereto. It will be apparent to those skilled in the art that modification may be made in the embodiments chosen for illustration without departing from the spirit and scope of the invention.

What is claimed is:

1. A hand-held game consisting of:

a. a basketball goal assembly including a backboard and a rim; and b. a finger ring attached to the back of the basketball goal assembly.

2. The hand-held game of claim 1 further including a net coupled to the rim, wherein the net is made of one of: nylon and plastic.

3. The hand-held game of claim 1 wherein the finger ring is adjustable to fit different sized fingers.

4. The hand-held game of claim 1 wherein the finger ring is an adjustable band including adjusters at ends of the band to fit different sized fingers.

5. The hand-held game of claim 4 wherein the adjustable band including the adjusters at the ends of the band include a strap including adjusters at ends of the strap.

6. The hand-held game of claim 1 wherein the finger ring is attached to the back of the basketball goal assembly using at least one of an adhesive, tape, snap-on clip, press fit mechanism, a mounting bracket, welding, and molding.

7. The hand-held game of claim 1 wherein the rim is coupled to the backboard via a mount.

8. The hand-held game of claim 1 wherein the rim is foldable.

9. The band-held game of claim 1 wherein the backboard and the rim are made of one of the following: plastic and metal.

10. A hand-held game consisting of:

a. a basketball goal assembly including a backboard and a rim; and b. a finger band attached to one of the back of the backboard and the rim of the basketball goal assembly.

11. The hand-held game of claim 10 further including a net coupled to the rim.

12. The hand-held game of claim 10 wherein the finger band is adjustable and includes adjusters at the ends of the band to fit different sized fingers.

13. The hand-held game of claim 10 wherein the finger band is attached to the one of the back of the backboard and the rim of the basketball goal assembly using at least one of an adhesive, tape, a snap-on clip, a press fit mechanism, a mounting bracket, welding, and molding.

14. The hand-held game of claim 10 wherein the rim is foldable.

15. The hand-held game of claim 10 wherein the finger band is a finger ring.

* * * * *